US009885132B2

(12) United States Patent
Shomura et al.

(10) Patent No.: US 9,885,132 B2
(45) Date of Patent: Feb. 6, 2018

(54) COMPRESSED AIR SUPPLYING DEVICE OF A SEWING MACHINE

(71) Applicant: Janome Sewing Machine Co., Ltd., Tokyo (JP)

(72) Inventors: Eiichi Shomura, Tokyo (JP); Ushio Yokoyama, Tokyo (JP); Shintaro Haraguchi, Tokyo (JP)

(73) Assignee: Janome Sewing Machine Co., Ltd., Tokyo (JP)

( * ) Notice: Subject to any disclaimer, the term of this patent is extended or adjusted under 35 U.S.C. 154(b) by 309 days.

(21) Appl. No.: 14/711,591

(22) Filed: May 13, 2015

(65) Prior Publication Data

US 2016/0160416 A1 Jun. 9, 2016

(30) Foreign Application Priority Data

Dec. 5, 2014 (JP) ..... 2014-246770

(51) Int. Cl.
*D05B 81/00* (2006.01)
*D05B 63/00* (2006.01)
(Continued)

(52) U.S. Cl.
CPC ..... *D05B 81/00* (2013.01); *D05B 63/00* (2013.01); *D05B 87/00* (2013.01); *F04B 9/042* (2013.01);
(Continued)

(58) Field of Classification Search
CPC ..... F04B 9/025; F04B 35/01; F04B 9/042; F04B 33/00; F04B 33/02; D05B 63/00; D05B 81/00
See application file for complete search history.

(56) References Cited

U.S. PATENT DOCUMENTS 1,806,268 A * 5/1931 Schulze ..... F02M 37/04 417/471
1,904,799 A * 4/1933 Palmer ..... F02M 21/00 137/512.3
(Continued)

FOREIGN PATENT DOCUMENTS

GB 593660 A 10/1947
GB 1195069 A 6/1970
(Continued)

OTHER PUBLICATIONS

Australian Patent Examination Report dated Mar. 24, 2016, issued in Australian Patent Application No. 2015202822 (7 pages).

*Primary Examiner* — Bryan Lettman
(74) *Attorney, Agent, or Firm* — Nakanishi IP Associates, LLC

(57) ABSTRACT

A compressed air supplying device of a sewing machine includes an air pump unit including a piston; a piston driving spring applying biasing force to the piston in an exhaust air direction which is a direction in which the air pump unit exhausts air for driving the piston in the exhaust air direction by the biasing force; a lever making the air pump unit perform intake air movements; and an operating force transmitting mechanism transmitting operating force of the lever to the piston for actuating the piston only in an intake air direction which is a direction in which the air pump unit intakes air against the biasing force of the piston driving spring by the operating force.

3 Claims, 19 Drawing Sheets

(51) Int. Cl.

| | |
|---|---|
| ***D05B 87/00*** | (2006.01) |
| ***F04B 9/04*** | (2006.01) |
| ***F04B 35/01*** | (2006.01) |
| ***F04B 39/00*** | (2006.01) |
| ***F04B 39/10*** | (2006.01) |
| ***F04B 39/12*** | (2006.01) |

(52) U.S. Cl.
CPC ..... *F04B 35/01* (2013.01); *F04B 39/0005* (2013.01); *F04B 39/1006* (2013.01); *F04B 39/122* (2013.01); *D05D 2207/04* (2013.01)

(56) References Cited

U.S. PATENT DOCUMENTS

| | | | | |
|---|---|---|---|---|
| 4,360,324 | A * | 11/1982 | Ohara | A61M 1/106 417/388 |
| 5,345,888 | A | 9/1994 | Frankel | |
| 2007/0116585 | A1 * | 5/2007 | Scalzi | F04B 9/042 417/470 |
| 2011/0129360 | A1 * | 6/2011 | Clinciu | F04B 35/01 417/53 |
| 2012/0210922 | A1 | 8/2012 | Sakuma et al. | |
| 2014/0008334 | A1 | 1/2014 | Ash et al. | |
| 2015/0167218 | A1 | 6/2015 | Sakuma et al. | |

FOREIGN PATENT DOCUMENTS

| | | | |
|---|---|---|---|
| JP | 06-277383 | A | 10/1994 |
| JP | H11-57269 | A | 3/1999 |
| JP | 2010-82150 | A | 4/2010 |
| WO | 2014/010108 | A1 | 1/2014 |

* cited by examiner

COMPRESSED AIR SUPPLYING DEVICE OF A SEWING MACHINE

CROSS REFERENCE TO RELATED APPLICATIONS

This application is based on and claims the benefit of priority to Japanese Patent Application No. 2014-246770 filed on Dec. 5, 2014, the content of which is hereby incorporated by reference in its entirety.

TECHNICAL FIELD

The present invention relates to a compressed air supplying device of a sewing machine used in a looper threading device of an overlock sewing machine.

BACKGROUND ART

An overlock sewing machine is provided with a plurality of loopers, and since it is necessary to thread each of the loopers with respectively different looper threads, threading operations were troublesome.

Patent Literature 1 discloses a device for threading a thread to a hollow looper point using compressed air.

In the above conventional device, when compressed air is sent to a thread path, a lever is manually pushed down for pushing a piston of an air pump in. Then, operations of the lever are directly linked with movements of the piston, so that the changes in lever operations have a direct effect on the movements of the piston. Namely, the velocities for pushing the piston differ with the forces for pushing down the lever. Accordingly, the flow velocities of compressed air were different depending on operations, so that there are some cases in which threads are not be delivered up to the looper points.

PRIOR ART LITERATURE

Patent Literature

[Patent Literature 1] Japanese Patent Laid-Open Publication No. 1994-277383

SUMMARY OF THE INVENTION

One or more embodiments of the present invention provide a compressed air supplying device of a sewing machine capable of supplying compressed air stably irrespective of operation manners of users.

Embodiment (1)

One or more embodiments of the present invention provide a compressed air supplying device of a sewing machine comprising an air pump portion including a piston; a piston biasing portion for biasing force to the piston in the direction which the air pump exhausts air, and for driving the piston in the exhaust air direction, by applying biasing force;

an operating member for making the air pump portion to perform intake air; and an operating force transmitting mechanism transmitting operating force of the operating member to the piston for actuating the piston only in an intake air direction in which the air pump portion intakes air against the biasing force of the piston biasing portion by the operating force.

Embodiment (2)

One or more embodiments of the present invention provide a compressed air supplying device of a sewing machine wherein in the compressed air supplying device of a sewing machine according to Embodiment (1), the operating member is a lever-like member capable of performing reciprocating movements, and wherein the operating force transmitting mechanism constitutes a ratchet mechanism outputting only rotations in one direction from among rotations generated by reciprocating movements of the operating member.

Embodiment (3)

One or more embodiments of the present invention provide a compressed air supplying device of a sewing machine wherein the compressed air supplying device of a sewing machine according to Embodiment (2) comprises; driving arm portion being swingably connected to the piston, and a piston returning arm portion provided to be swingably and integrally with the driving arm portion and being rotationally moved by means of a cam portion provided at the operating force transmitting mechanism in a direction in which the piston moves in the intake air direction, wherein the piston biasing portion applies biasing force to the piston by means of the piston driving shaft portion and, wherein when the operating member is operated in a specified direction, the piston returning arm portion is moved by the cam portion to move the piston in the intake air direction up to a specified position, and when the specified position is exceeded, engagement between the cam portion and the piston returning arm portion (18) is released such that the piston is driven in the exhaust air direction by the biasing force of the piston biasing portion.

According to one or more embodiments of the present invention, the compressed air supplying device of a sewing machine is capable of supplying compressed air stably manner irrespective of operation manners of users.

DETAILED DESCRIPTION

An example for carrying out the present invention will now be explained with reference to the drawings and others.

Embodiment

Figure 1:
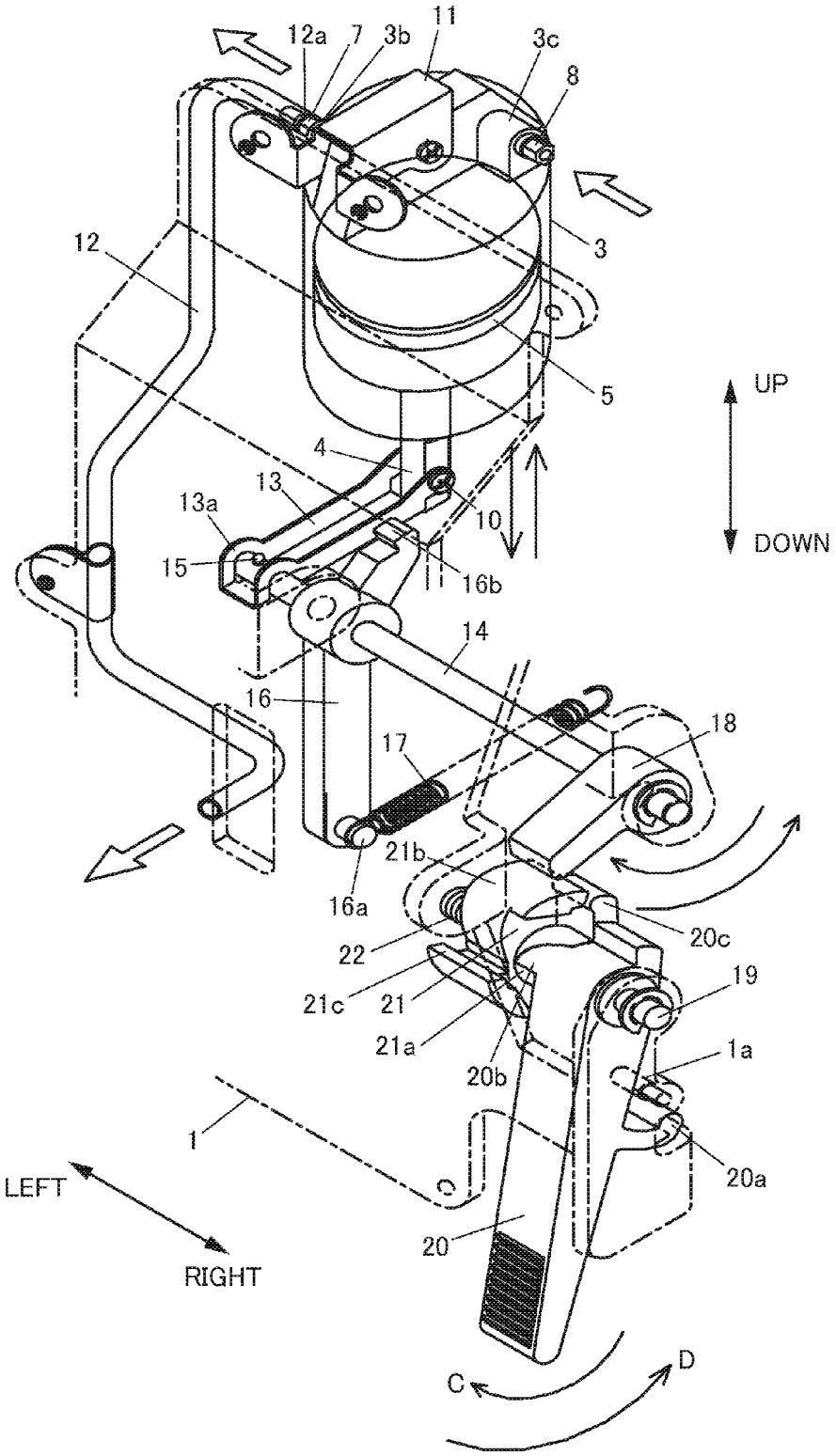
FIG. 1 A view of a showing an embodiment of a compressed air supplying device of a sewing machine according to one or more embodiments of the present invention.

FIG. 1 is a view of a showing an embodiment of a compressed air supplying device of a sewing machine according to the present invention.

Figure 2:
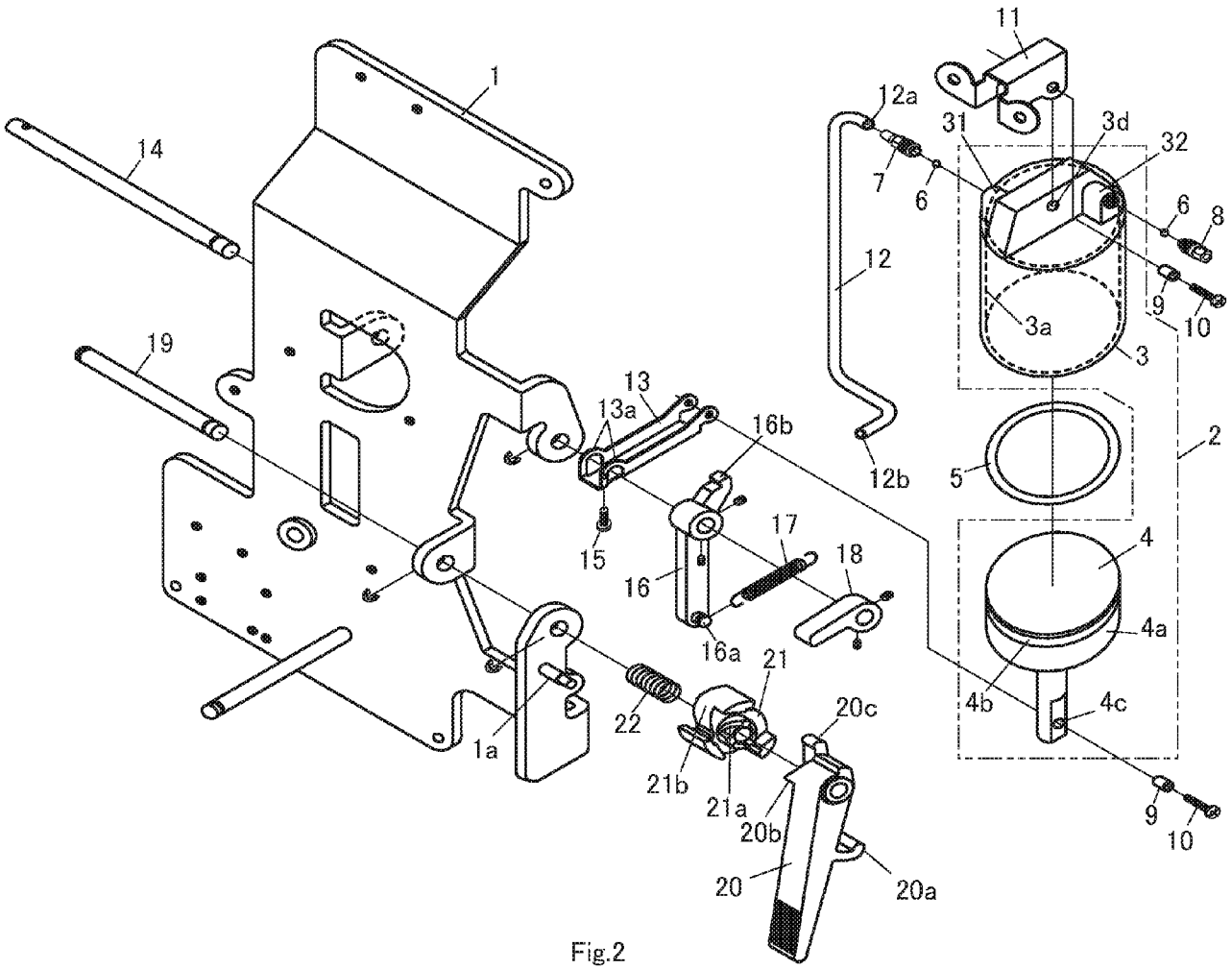
FIG. 2 An exploded perspective view of the compressed air supplying device.

FIG. 2 is an exploded perspective view of the compressed air supplying device.

Each of the drawings indicated hereinafter including FIG. 1 and FIG. 2 are schematically illustrated drawings, and sizes and shapes of respective portions are shown in suitably exaggerated form for ease of understanding.

Further, while explanations are made upon indicating specific numerical values, shapes and materials in the following explanations, they may be suitably changed.

Moreover, for ease of understanding and for convenience sake, explanations will be made by suitably using the directions of left, right, up and down as indicated by arrows in FIG. 1. However, these directions are not to limit the arrangement of the invention.

The compressed air supplying device according to the present embodiment is assembled in a sewing machine main body (not shown) or a unit base 1.

An air pump unit (air pump portion) 2 is comprised of an air pump 3 and a piston 4, wherein an outer peripheral surface 4*a* of the piston 4 fitting with an inner peripheral surface 3*a* of the air pump 3 is formed with a groove 4*b* into which an O ring 5 is fit. The air pump unit 2 generates compressed air through reciprocating movements of the piston 4 within the air pump 3.

The O ring 5 prevents leakage of air from a sliding surface between the inner peripheral surface 3*a* of the air pump 3 and the outer peripheral surface of the piston 4 during reciprocating movements of the piston 4.

The air pump 3 includes a through hole 3*d* on an upper end thereof and by inserting a bush 9, it is held to be swingably with respect to an air pump mounting plate 11 by means of a screw 10.

The air pump 3 includes an exhaust air opening 31 and an intake air opening 32, wherein a check valve 7 accommodating a small ball 6 is screw-coupled to the exhaust air opening 31. A check valve 8 similarly accommodating a small ball 6 is screw-coupled to the intake air opening 32.

A tube 12 is arranged in that one end 12*a* is coupled to the check valve 7 while the other end 12*b* is coupled to an inlet of a thread delivering mechanism (not shown). Accordingly, compressed air generated by the air pump unit 2 is introduced through the tube 12 to the thread delivering mechanism.

The check valve 7 and the check valve 8 restrict intake air actions and exhaust air actions of the air pump 3, and when the air pump 3 performs intake air and exhaust air in accordance with reciprocating movements of the piston 4, the exhaust air is directed only towards the thread delivering mechanism side while intake air is not performed from the thread delivering mechanism side.

Figure 3:
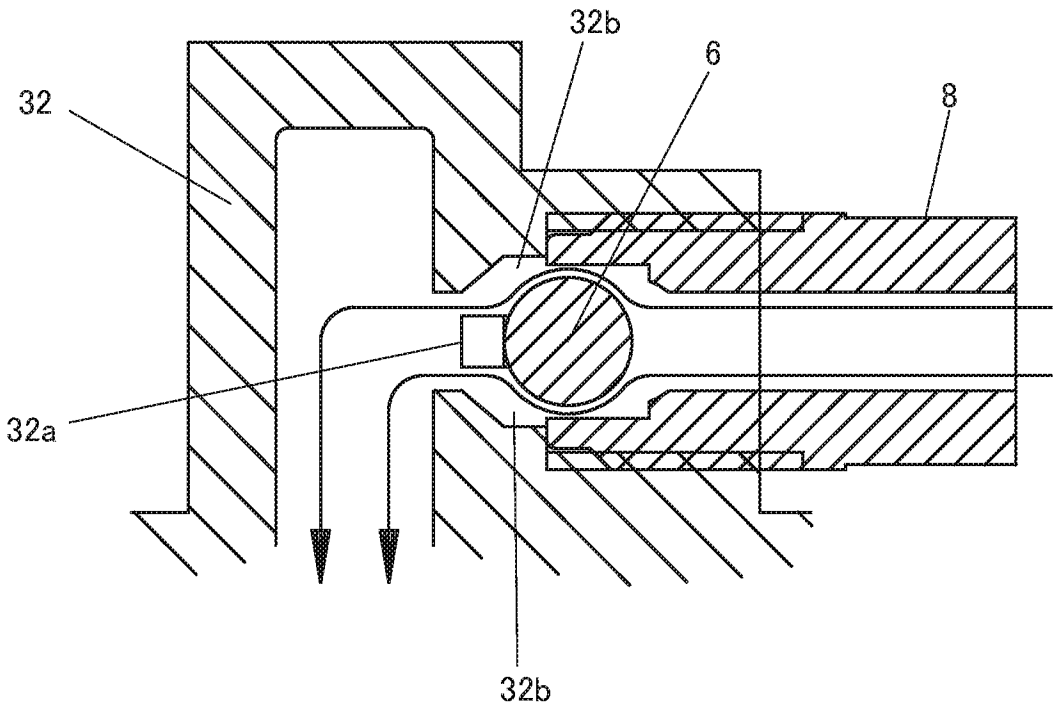
FIG. 3 A sectional view of an intake air opening 32 at the time of intake.

FIG. 3 is a sectional view of the intake air opening 32 at the time of intake air.

At the time of intake air, the small ball 6 inserted into the check valve 8 screw-fastened to the intake air opening 32 of the air pump 3 is sucked in a depth direction of the intake air opening 32 with the descending of the piston 4, abuts a rib 32*a* and is stopped thereat. At this time, outside air passes through a clearance 32*b* and flows into the air pump 3.

Figure 4:
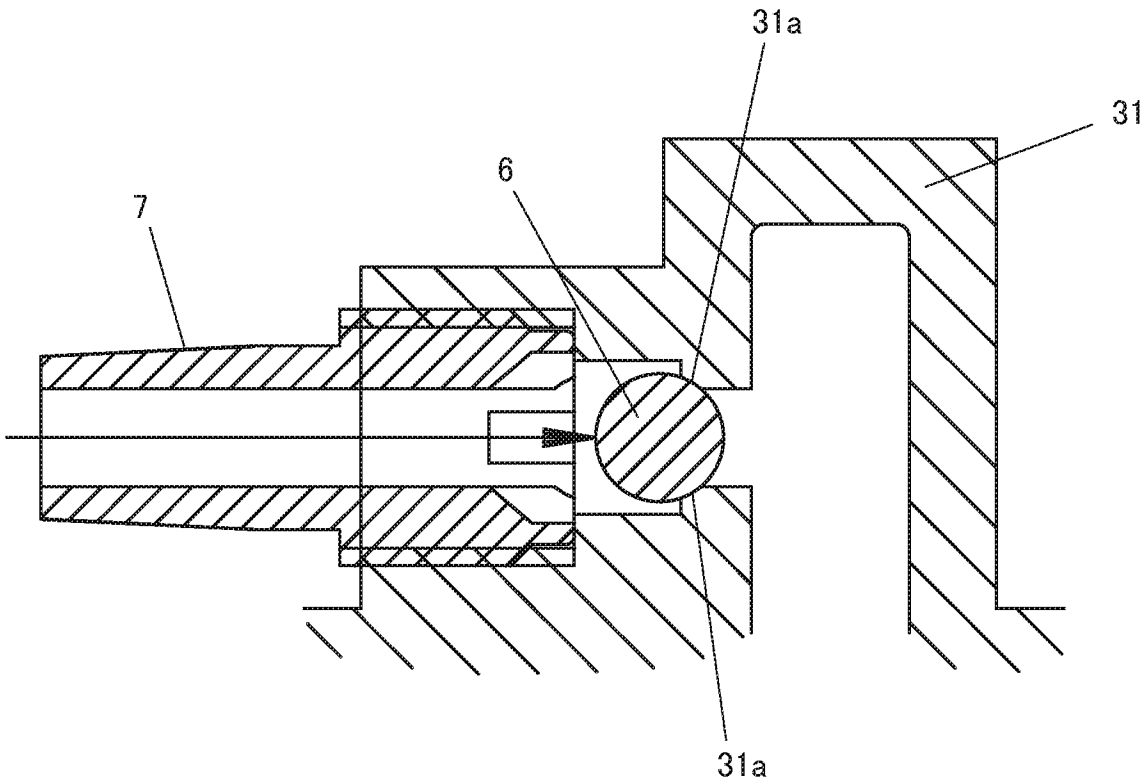
FIG. 4 A sectional view of an exhaust air opening 31 at the time of intake air.

FIG. 4 is a sectional view of the exhaust air opening 31 at the time of intake air.

In the exhaust air opening 31 at the time of intake air, the small ball 6 inserted into the check valve 7 screw-fastened to the exhaust air opening 31 is sucked in a depth direction of the exhaust air opening 31 with the descending of the piston 4 and is stopped at an exhaust air opening seat surface 31*a* to prevent inflow of outside air. The check valve 7 has the tube 12 coupled to its other end and communicates with the thread delivering mechanism by means of the tube 12, so that the actions of sucking air from the thread delivering mechanism will not be generated when the piston 4 descends. Namely, the flow of air which pulls a thread inserted into the thread delivering mechanism back will not be generated at the time of intake air.

Figure 5:
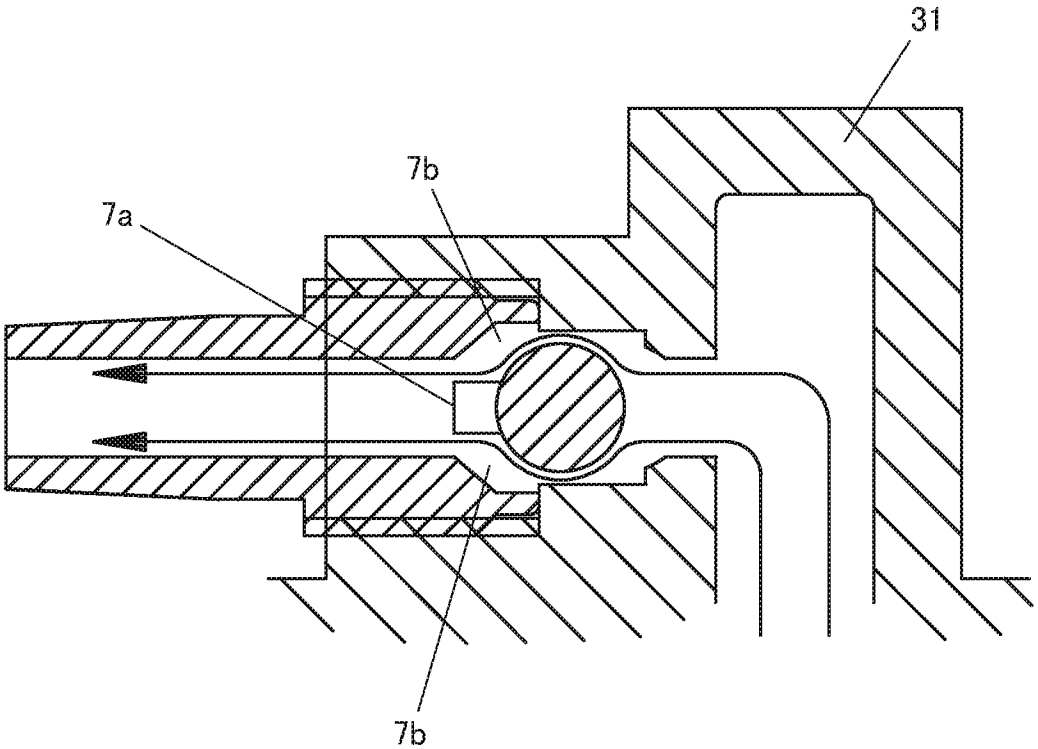
FIG. 5 A sectional view of the exhaust air opening 31 at the time of exhaust air.

FIG. 5 is a sectional view of the exhaust air opening 31 at the time of exhaust air.

Next, at the time of exhaust air, the small ball 6 of the exhaust air opening 31 is pushed out in the direction of the check valve 7 with the ascending of the piston 4, abuts a rib 7*a* of the check valve 7 and is stopped thereat. At this time, air within the air pump 3 passes through a clearance 7*b* and is exhausted to the exterior. As the check valve 7 communicates with the thread delivering mechanism by means of the tube 12, the air within the air pump 3 flows into the thread delivering mechanism.

Figure 6:
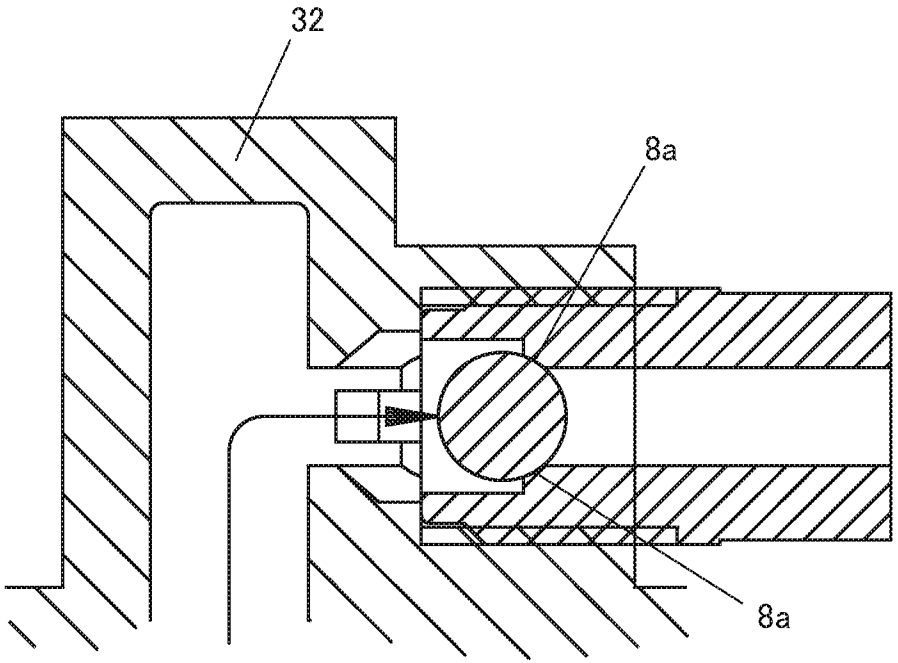
FIG. 6 A sectional view of the intake air opening 32 at the time of exhaust air.

FIG. 6 is a sectional view of the intake air opening 32 at the time of exhaust air.

In the intake air opening 32 at the time of exhausting air, the small ball 6 of the intake air opening 32 is pushed out in the direction of the check valve 8 with the ascending of the piston 4 and is stopped at an intake air opening seat surface 8*a* of the check valve 8 to prevent outflow of the air within the air pump 3.

In this manner, the outside air flows in only from the intake air opening 32 at the time of descending of the piston 4, while the air within the air pump 3 is exhausted only from the exhaust air opening 31 at the time of ascending of the piston 4.

Returning to FIG. 1 and FIG. 2, a piston connecting plate 13 is mounted to a lower end of the piston 4 to be swingably with respect to the piston 4. More specifically, a through hole 4*c* is provided at the lower end of the piston 4 wherein the bush 9 is inserted into the through hole 4*c* and the piston 4 is mounted to one end of the piston connecting plate 13 in a swingable manner by using a screw 10. A receiving portion 13*a* is formed at the other end of the piston connecting plate 13, and one end of a piston driving shaft 14 is fixed thereto by means of a screw 15. With this arrangement, the piston connecting plate 13 is provided to rotate integrally with the piston driving shaft 14, connects the piston 4 and the piston driving shaft 14, and transmits rotation of the piston driving shaft 14 to the piston 4 as reciprocating movements of the piston 4.

The piston driving shaft 14 is held at the sewing machine main body or the unit base 1 in a freely rotatable manner. The piston driving shaft 14 fixes the piston connecting plate 13, a piston driving arm 16 and a piston returning arm 18 on the shaft. The piston driving shaft 14, the piston connecting plate 13, the piston driving arm 16 and the piston returning arm 18 are integrated as a piston driving shaft portion and are swingably with the center being the piston driving shaft 14.

The piston driving arm 16 is fixed to an intermediate portion of the piston driving shaft 14. A spring peg 16*a* is provided at one end of the piston driving arm 16 while a stopper driving surface 16*b* is formed at the other end thereof. One end of the piston receiving spring 17 engages with the spring peg 16*a*, and the other end of the piston driving spring 17 is held at a suitable position of the sewing machine main body. With this arrangement, the piston driving shaft 14 is continuously biased in a counterclockwise direction (when seen from the right-side surface of the sewing machine). Accordingly, the piston 4 is continuously biased by the piston driving shaft 14 and the piston connecting plate 13 in the ascending direction, namely in the direction in which the air pump unit 2 performs exhaust air.

The piston driving spring (piston biasing portion) 17 is engaged with the spring peg 16*a* of the piston driving arm 16 and functions as a power source for pushing the piston 4 into the air pump 3.

The piston driving arm 16 is fixed to the piston driving shaft 14 and rotates with the piston driving shaft 14 as the center. The piston driving shaft 16 engages with the piston driving spring 17 by including the spring peg 16*a* at one end thereof. And, its biasing force make to rotate the piston driving shaft 14, so that movements of pushing the piston 4 perform.

The piston connecting plate 13 and the piston driving arm 16 have functions as a driving arm portion for transmitting the biasing force of the piston driving spring (piston biasing portion) 17 to the piston 4. The piston connecting plate 13 and the piston driving arm 16 might be comprised by different parts as in the present embodiment, and it is also possible to integrate and comprise them as a single part.

The piston returning arm (piston returning arm portion) 18 is fixed to the piston driving shaft 14 and transmits movements of the lever 20 to the piston driving shaft 14. By transmitting movements of the lever 20 to the piston driving shaft 14, the piston returning arm 18 returns the piston 4 from the pushed in state to the intake air state. After the piston returning arm 18 is pushed up clockwise (when seen from the right-side surface), by a lead cam surface (cam portion) 21*b* of an intermediate arm 21 to be described later, is detached from the lead cam surface 21*b* to rotate counterclockwise (when seen from the right-side surface) at once. Accordingly, the piston returning arm 18 pushes the piston 4 in, thereby changes the air pump 3 into the exhaust air state.

A lever shaft 19 is held at the sewing machine main body or unit base 1 in a freely rotatable manner. The lever 20 is inserted into a right end of the lever shaft 19 while the intermediate arm 21 is inserted to the left side thereof in a freely rotatable manner, and an intermediate arm spring 22 is fitted to the left end of the lever shaft 19 so as to bias the intermediate arm 21 in the direction of the lever 20.

The intermediate arm 21 is a member held at the lever shaft 19 in a freely rotatable manner for transmitting power from the lever 20 to the piston returning arm 18. The intermediate arm 21 also rotates the piston returning arm 18 by means of the lead cam surface 21*b*.

Moreover, the intermediate arm 21 is ratchet-coupled to the lever 20. As the lever 20 is rotated counterclockwise when seen from the right-side surface of the sewing machine, the intermediate arm 21 rotates counterclockwise (when seen from the right side) fitting with the lever 20 at a first fitting phase. With this arrangement, the piston returning arm 18 is rotated in a returning direction. On the other hand, when the lever 20 is rotated clockwise (when seen from the right side), the intermediate arm 21 is displaced to the left side against the intermediate arm spring 22. Next, when the lever 20 has rotated in a second fitting phase, the intermediate arm 21 returns to the right side by means of the biasing force of the intermediate arm spring 22.

In ratchet-coupling of the lever 20 and the intermediate arm 21, the intermediate arm spring 22 allows that the intermediate arm 21 displaces in lateral directions on the lever shaft 19 by means of biasing the intermediate arm 21 to the lever 20 side continuously.

The lever 20 is an operating member held at the right end of the lever shaft 19 in a freely rotatable manner for making the air pump unit 2 perform intake air by a user's operation. The lever 20 is ratchet-coupled to the intermediate arm 21 on the lever shaft 19. The lever 20 also allow that the piston 4 change from intake air movement to exhaust air movement by performing a single reciprocating of clockwise and counterclockwise (when seen from the right side).

A lever stopper 1*a* is a pin for stably holding the lever 20 at a terminating position of counterclockwise operations (when seen from the right side), and at the time of the completion of exhaust air by means of operating the lever 20. An arm portion hook 20*a* which integrally formed with the lever 20 comes into contact with the lever stopper 1*a*.

A ratchet mechanism formed by the lever 20, the intermediate arm 21 and the intermediate arm spring 22 allow to output only one direction of rotation from among rotations generated through reciprocating swinging of the lever 20. An operating force transmitting mechanism is constituted by the lever 20, the intermediate arm 21, the intermediate arm spring 22, the piston returning arm 18, the piston driving shaft 14, the piston driving arm 16 and the piston connecting plate 13. The operating force transmitting mechanism transmits the operating force to piston 4 against the biasing force of the piston driving spring (piston biasing portion) 17 by means of operating force of the lever (operating portion) 20 so that the air pump unit (air pump portion) 2 allow to actuate the piston 4 only in the intake air direction.

Movements of the ratchet-coupled portion between the lever 20 and the intermediate arm 21 will be explained here.

Figure 7:
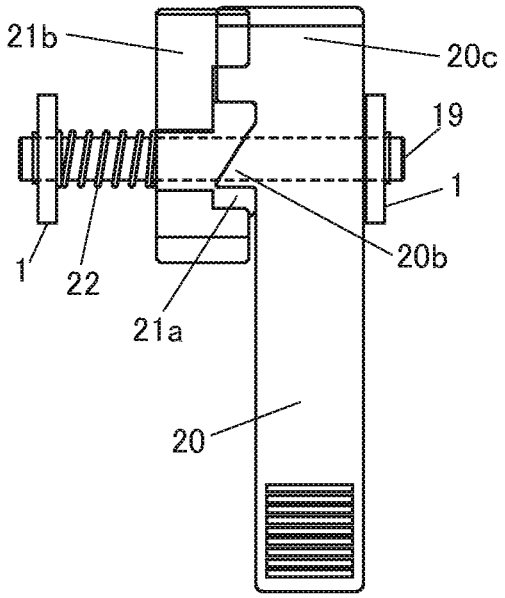
FIG. 7 A view showing a stopped state of a lever 20 in which threading operations are completed by abutting a bottom dead center of a movable range of the lever 20.

FIG. 7 is a view showing a stopped state of the lever 20 in which threading operations are completed by abutting a bottom dead center of a movable range of the lever 20.

Figure 8:
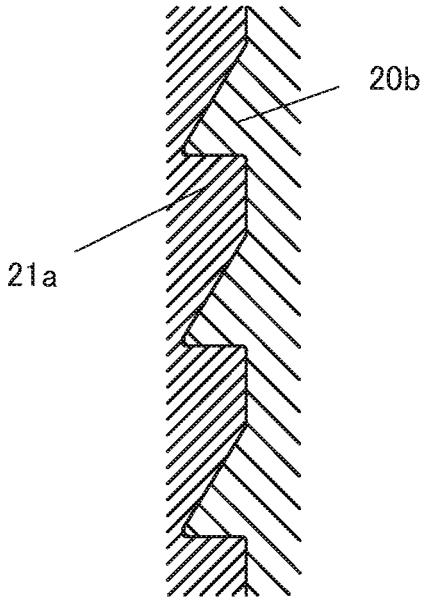
FIG. 8 A sectional view showing engaging portions between tooth portions 20*b* and tooth portions 21*a* in the state of FIG. 7 in developed form along a peripheral direction.

FIG. 8 is a sectional view showing engaging portions between tooth portions 20*b* and tooth portions 21*a* in the state of FIG. 7 in developed form along a peripheral direction.

The states of FIG. 7 and FIG. 8 show a bottom dead center of a movable range of the lever 20. Figs also show that the arm portion hook 20*a* of the lever 20 upon completion of threading operations is held by means of coming into contact with lever stopper 1*a* of the unit base 1. In this state, the tooth portions 20*b* of the lever 20 engage with the tooth portions 21*a* of the intermediate arm 21, and the intermediate arm 21 is biased towards the lever 20 side by means of the intermediate arm spring 22.

Figure 9:
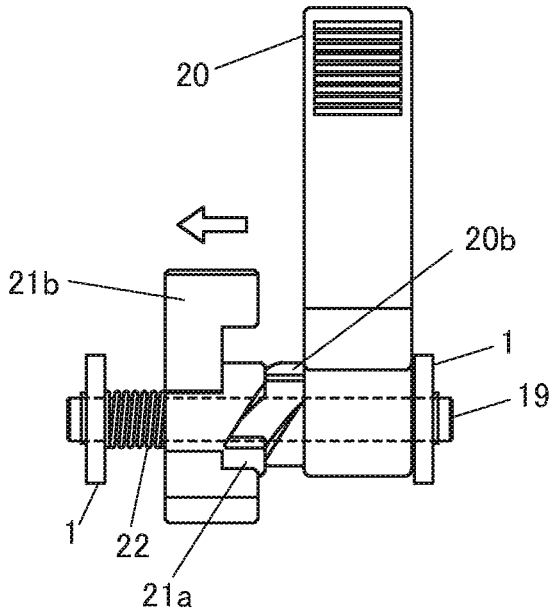
FIG. 9 A view showing a state for preparing driving of the lever 20 for performing threading operations.

FIG. 9 is a view showing a state for preparing driving of the lever 20 for performing threading operations.

Figure 10:
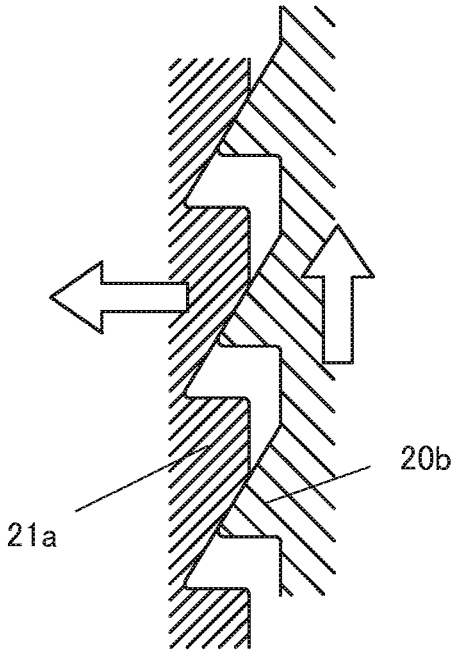
FIG. 10 A sectional view showing an engaging portion between one tooth portion 20*b* and one tooth portion 21*a* in the state of FIG. 9 in developed form along a peripheral direction.

FIG. 10 is a sectional view showing an engaging portion between one tooth portion 20*b* and one tooth portion 21*a* in the state of FIG. 9 in developed form along a peripheral direction.

Figure 11:
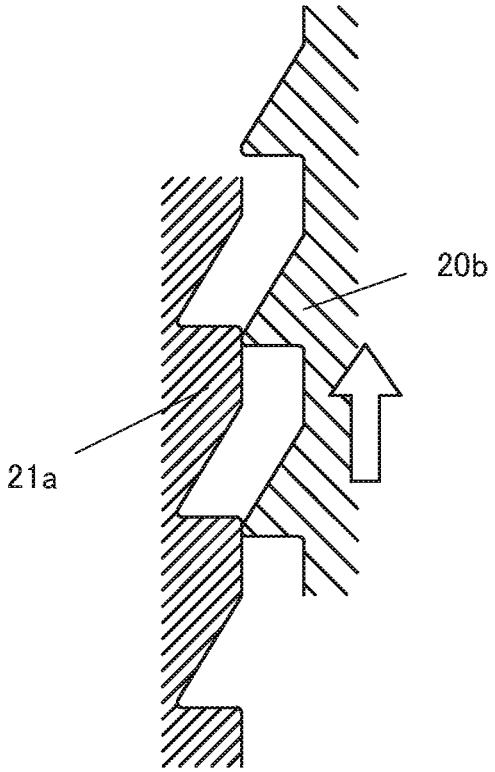
FIG. 11 A view showing a state in which driving has further proceeded from the state of FIG. 10.

FIG. 11 is a view showing a state in which driving has further proceeded from the state of FIG. 10.

FIG. 9 to FIG. 11 show that the lever 20 is rotating in a direction of arrow C shown in FIG. 1. FIG. 10 shows that a sloped surface of one tooth portion 20*b* of the lever 20 is climbing up a sloped surface of one tooth portion 21*a* of the intermediate portion 21. In this state, the intermediate arm 21 is pushed by the lever 20, so that it is pushed out to the left side against the intermediate arm spring 22. When the lever 20 is further kept rotating in the direction of arrow C, it will be in the state shown in FIG. 11, so that the tooth portion 20*b* of the lever 20 finishes climbing of the tooth portion 21*a* of the intermediate arm 21 to engage the next tooth portion of the intermediate arm 21.

Figure 12:
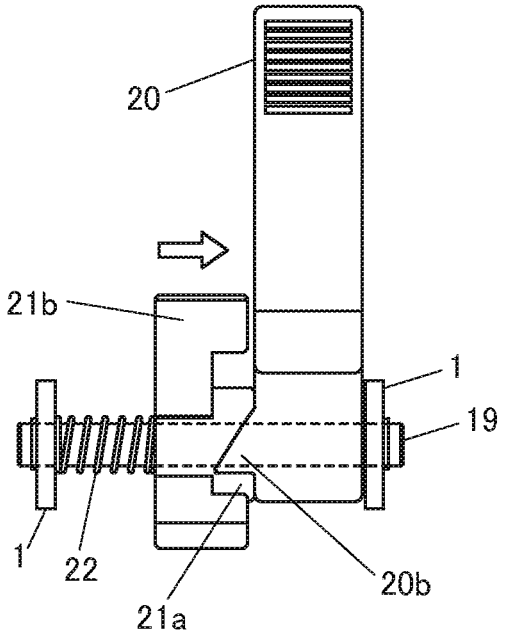
FIG. 12 A view showing a state in which driving of the lever 20 is possible for performing threading operations.

FIG. 12 is a view showing a state in which driving of the lever 20 is possible for performing threading operations.

Figure 13:
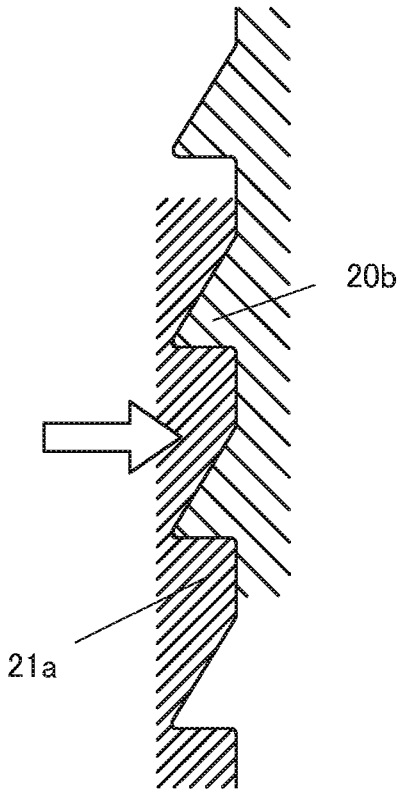
FIG. 13 A sectional view showing engaging portions between tooth portions 20*b* and tooth portions 21*a* in the state of FIG. 12 in developed form along a peripheral direction.

FIG. 13 is a sectional view showing engaging portions between tooth portions 20*b* and tooth portions 21*a* in the state of FIG. 12 in developed form along a peripheral direction.

FIG. 12 and FIG. 13 show the state that the lever 20 is possible for performing threading operations as the preparations are completed. In this state, one tooth portion 20*b* of the lever 20 meshes with a tooth of a next step of the tooth portions 21*a* of the intermediate arm 21 again, after that, the intermediate arm 21 repeatedly moves to the lever 20 side by the intermediate arm spring 22, whence the lever 20 can be rotated in the direction of arrow D in FIG. 1. As the tooth portions 20*b* of the lever 20 and the tooth portions 21*a* of the intermediate arm 21 fit with each other and the lever 20 is rotated in the direction of arrow D, the intermediate arm 21 rotates in the counterclockwise direction (when seen from the right side of the sewing machine).

Next, behaviors of the piston 4 accompanying driving of the lever 20 for threading operations will be explained.

FIG. 14 to FIG. 19 are views for explaining operations of the lever 20 and the piston 4. In these drawings, it is assumed that movements proceed from the state of FIG. 14 to that of FIG. 19 in the order of the drawings.

Figure 14:
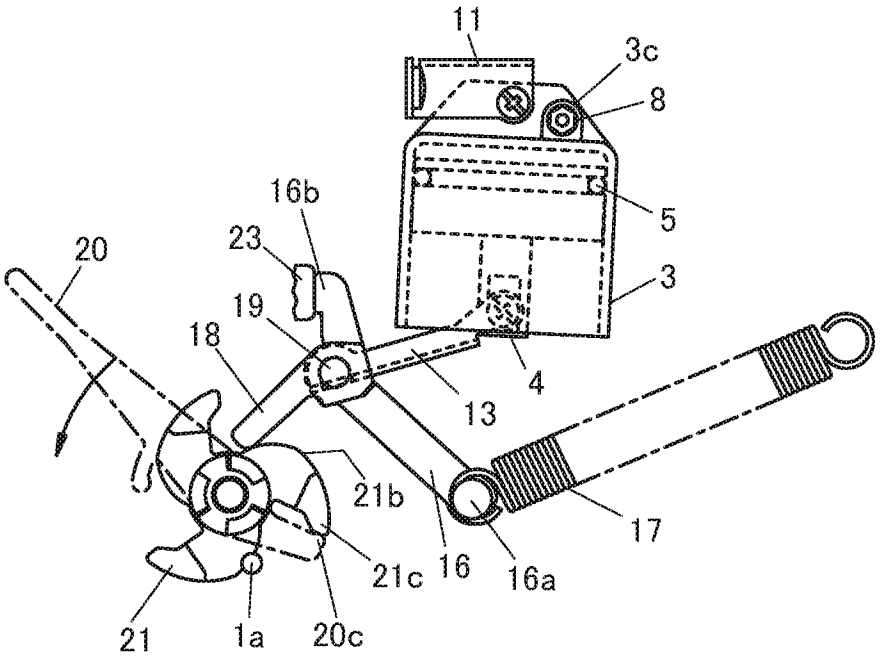
FIG. 14 A view for explaining operations of the lever 20 and a piston 4.

At a point of time in which rotation of the lever 20 is started from the state of FIG. 12 and FIG. 13 in the direction of arrow D in FIG. 1, the tip of the piston returning arm 18 comes into contact with a minimum diameter portion of the lead cam surface 21*b* of the intermediate arm 21 as shown in FIG. 14. On the other hand, as the piston driving arm 16 is biased counterclockwise in the drawing by the piston driving spring 17, the piston driving arm 16 stops by means of coming into contact with a piston driving arm stopper 23. Exhaust air movement strokes of the piston 4 are restricted by the piston driving arm stopper 23.

Figure 15:
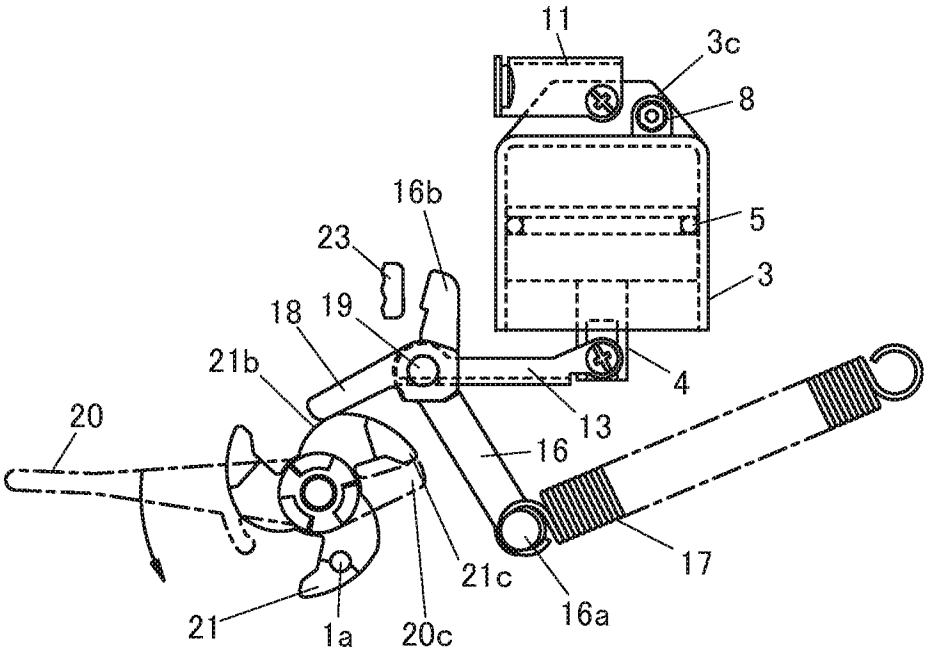
FIG. 15 A view for explaining operations of the lever 20 and the piston 4.

When movements shift from the state of FIG. 14 to the state of FIG. 15, the lever 20 is rotated to push the tip of the piston returning arm 18 up to an intermediate diameter portion of the lead cam surface 21*b* of the intermediate arm 21 against the piston driving spring 17. With this arrangement, as the piston 4 descends, the air pump 3 intakes air.

Figure 16:
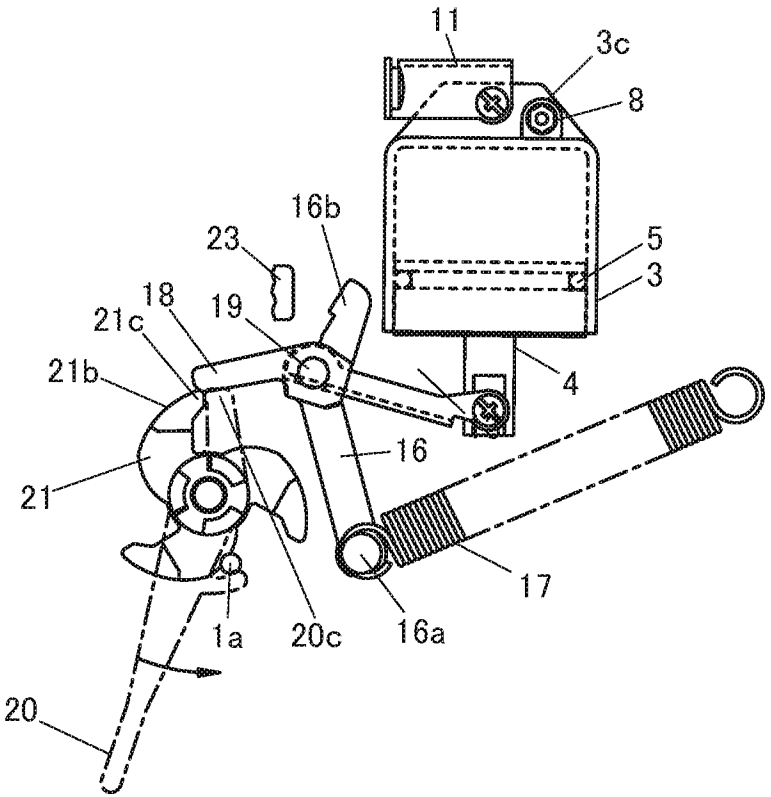
FIG. 16 A view for explaining operations of the lever 20 and the piston 4.

When movements shift from the state of FIG. 15 to the state of FIG. 16, as the lever 20 is further rotated, the tip of the piston returning arm 18 reaches a maximum diameter portion of the lead cam surface 21*b* of the intermediate arm 21. With this arrangement, as the piston 4 reaches a lowest point, the air pump 3 also reaches a maximum intake air state.

Figure 17:
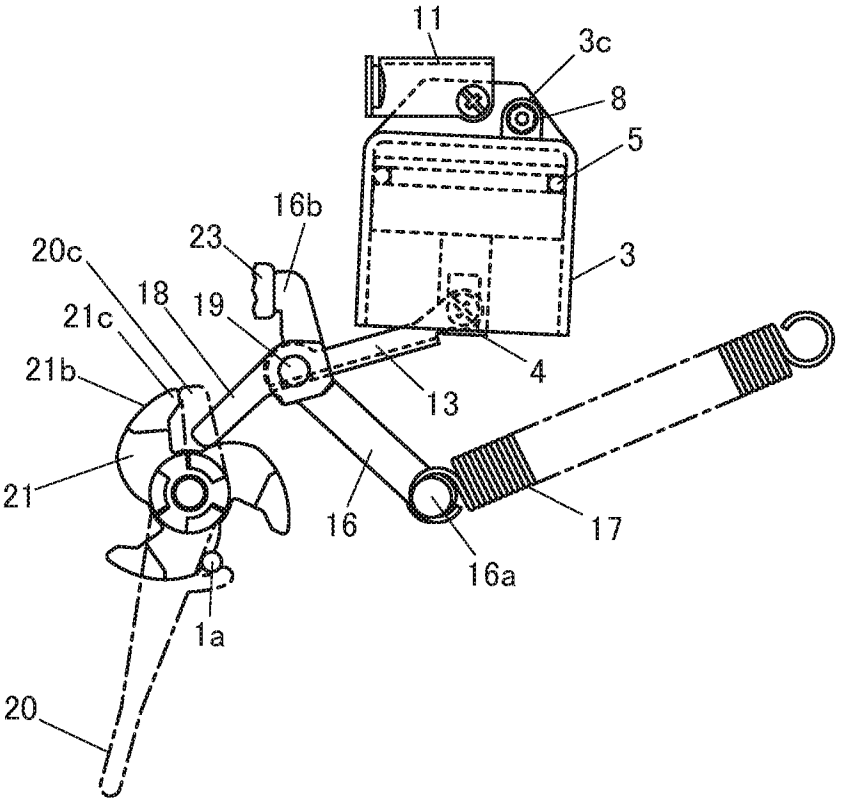
FIG. 17 A view for explaining operations of the lever 20 and the piston 4.

When movements shift from the state of FIG. 16 to the state of FIG. 17, in the moment the lever 20 moves slightly from the state of FIG. 16, the tip of the piston return arm 18 drops from the lead cam surface 21*b* of the intermediate arm 21, and falls to the minimum diameter portion of the next lead cam surface at once by the biasing force of the piston driving spring 17. With this arrangement, as the piston 4 is also ascended at once, the air pump 3 exhausts air within the air pump 3 at a stroke. Namely, as compressed air flows into the thread delivering mechanism at once, it is possible to deliver the thread.

Figure 18:
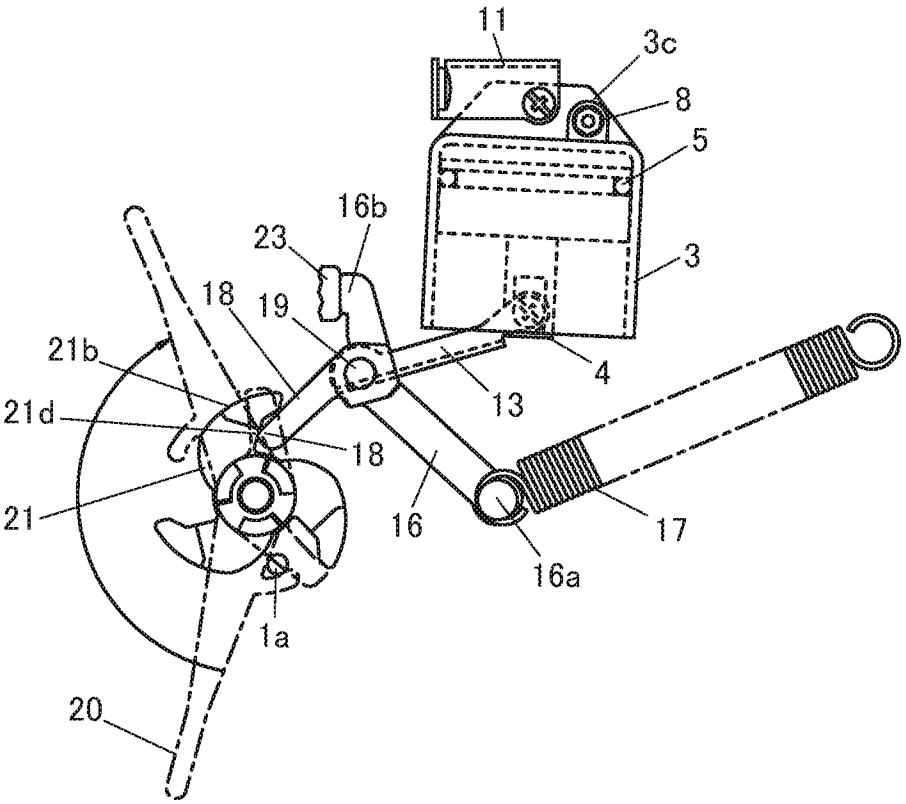
FIG. 18 A view for explaining operations of the lever 20 and the piston 4.

FIG. 18 shows that the lever 20 is rotated in the direction of arrow C in FIG. 1 for the next threading operations, so that the tooth portions 20*b* of the lever 20 are engage with the next tooth portions 21*a* of the intermediate arm 21. As the tip of the piston returning arm 18 come into contact with a rear surface 21*d* of the intermediate arm 21 to prevent rotation of the intermediate arm 21, thereby clutch coupling between the lever 20 and the intermediate arm 21 is performed smoothly. This corresponds to the states of FIG. 12 and FIG. 13.

Figure 19:
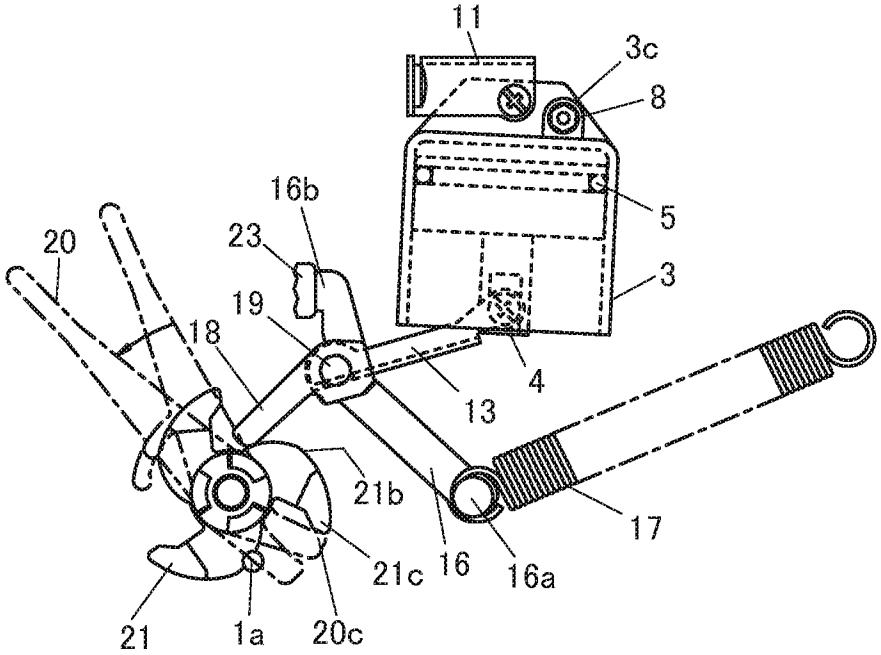
FIG. 19 A view for explaining operations of the lever 20 and the piston 4.

FIG. 19 shows that rotation of the lever 20 is reversed from the state of FIG. 18 to move slightly in the direction of arrow D in FIG. 1, thereby a tip 20*c* of the lever 20 comes into contact with the tip 21*c* of the intermediate arm 21. On the other hand, the tip of the piston returning arm 18 come into contact with the minimum diameter portion of the lead cam surface 21*b* of the intermediate arm 21. Namely, it means that the state go back to the state of FIG. 14, so that it has become possible to perform the next threading operations.

As explained above, according to the present embodiment, the compressed air supplying device make possible to drive the air pump unit at constant driving force by operating a manual lever without using a compressor or a motor or the like at low cost. Accordingly, the compressed air supplying device of the present embodiment become possible to supply compressed air stably irrespective of operation manners of users.

Moreover, the compressed air supplying device of the present embodiment can be comfortably used with no driving sounds caused by the use of an electric motor or the like.

Modified Embodiment

As the present invention is not limited to the above-described embodiment, various modifications and changes of the embodiment are included in the scope of the present invention.

The present embodiment has been explained by giving an example in which a ratchet mechanism is used for transmitting only operations in one direction of the lever 20 to the piston 4. The present invention is not limited to this, and any mechanism can be used even if only operations in one direction of the operating member can be transmitted to the piston. For instance, it is possible to apply a mechanism of a known one-way clutch.

Further, the present embodiment has been explained by giving an example of a compressed air supplying device using the swingably-operated lever 20 as an operating member. The present invention is not limited to this, and it is, for instance, possible to use a rotationally-operated operating member in the compressed air supplying device.

Further, the present embodiment has been explained by giving an example of a compressed air supplying device using the manually-operated lever 20 as an operating member. The present invention is not limited to this, and it is, for instance, possible to apply an electric motor-operated operating member using a motor or solenoid or the like to the present invention. In a case of using electric motor-operated, the compressed air supplying device makes possible to supply stably compressed air by biasing the piston 4 in the exhaust air direction using spring force, with a simple structure.

In this respect, the present invention is not to be limited by the above-explained embodiments.

DESCRIPTION OF THE REFERENCE NUMERALS

1 Unit base
1*a* Lever stopper
2 Air pump unit
3 Air pump
3*a* Inner peripheral surface
3*d* Through hole
4 Piston
4*a* Outer peripheral surface
4*b* Groove
4*c* Through hole
5 O ring
6 Small ball
7 Check valve
7*a* Rib
7*b* Clearance
8 Check valve
8*a* Intake air opening seat surface
9 Bush
10 Screw
11 Air pump mounting plate
12 Tube
12*a* One end
12*b* Other end
13 Piston connecting plate
13*a* Receiving portion
14 Piston driving shaft
15 Screw
16 Piston driving arm
16*a* Spring peg
16*b* Stopper receiving surface
17 Piston driving spring
18 Piston returning arm
19 Lever shaft
20 Lever
20*a* Arm portion hook
20*b* Tooth portion
20*c* Tip
21 Intermediate arm
21*a* Tooth portion
21*b* Lead cam surface
21*c* Tip
21*d* Rear surface
22 Intermediate arm spring
23 Piston driving arm stopper
31 Exhaust air opening
31*a* Exhaust air opening seat surface
32 Intake air opening
32*a* Rib
32*b* Clearance

The invention claimed is:

1. A compressed air supplying device of a sewing machine comprising:

an air pump portion including a piston;

a piston driving shaft connected to the piston, wherein the piston driving shaft rotates in a first circumferential direction of the shaft so as to actuate the piston for exhausting air from the air pump portion and rotates in a second circumferential direction of the shaft opposite to the first circumferential direction so as to actuate the piston for intaking air into the air pump portion;

a piston driving arm fixed to the piston driving shaft;

a piston biasing portion engaged with an end of the piston driving arm, wherein the piston biasing portion applies a biasing force to the piston driving shaft to rotate in the first circumferential direction, such that the piston is actuated to exhaust the air;

a rotatable operating member;

an intermediate arm disposed adjacent to the rotatable operating member, wherein the intermediate arm rotates interlockingly with rotation in only one rotational direction of the operating member;

a piston returning arm fixed to the piston driving shaft, wherein in a predetermined rotation range of the intermediate arm, the piston returning arm is engaged with the intermediate arm thereby forcing the piston driving shaft to rotate in the second circumferential direction against the biasing force applied by the piston biasing portion, and outside the predetermined rotation range, the piston returning arm is released from the engagement with the intermediate arm thereby not forcing the piston driving shaft to rotate in the second circumferential direction.

2. The compressed air supplying device of the sewing machine according to claim 1, wherein the intermediate arm has a same rotational axis as the operating member, and comprises a cam portion around the rotational axis; and wherein the piston returning arm is engaged with the rotation of the intermediate arm via the cam portion.

3. The compressed air supplying device of the sewing machine according to claim 1, wherein the operating member is ratchet-coupled to the intermediate arm.

* * * * *